US007048051B2

(12) United States Patent
McQueen

(10) Patent No.: US 7,048,051 B2
(45) Date of Patent: May 23, 2006

(54) RECOVERY OF PRODUCTS FROM OIL SHALE

(75) Inventor: Ronald E. McQueen, Park City, UT (US)

(73) Assignee: Gen Syn Fuels, Kalispell, MT (US)

( * ) Notice: Subject to any disclaimer, the term of this patent is extended or adjusted under 35 U.S.C. 154(b) by 0 days.

(21) Appl. No.: 10/357,718

(22) Filed: Feb. 3, 2003

(65) Prior Publication Data

US 2004/0149433 A1 Aug. 5, 2004

(51) Int. Cl.
*E21B 43/24* (2006.01)

(52) U.S. Cl. ..... 166/261; 166/259

(58) Field of Classification Search ..... 166/261, 166/247, 256, 259, 266, 267, 271, 272, 50
See application file for complete search history.

(56) References Cited

U.S. PATENT DOCUMENTS 4,133,381 A * 1/1979 Stewart ..... 166/261
4,246,965 A * 1/1981 Cha ..... 166/250.15
4,269,449 A * 5/1981 del Rio ..... 299/2
4,384,614 A * 5/1983 Justheim ..... 166/259
4,401,162 A * 8/1983 Osborne ..... 166/248
4,425,967 A * 1/1984 Hoekstra ..... 166/259
4,637,464 A * 1/1987 Forgac et al. ..... 106/261

* cited by examiner

*Primary Examiner*—Frank Tsay
(74) *Attorney, Agent, or Firm*—Sarah J. Rhoades; Patrick N. Burkhart

(57) ABSTRACT

A process and system for recovering hydrocarbonaceous products from in situ oil shale formations. A hole is drilled in the oil shale formation and a processing gas inlet conduit is positioned within the hole. A processing gas is pressurized, heated, and introduced through the processing gas inlet conduit and into the hole. The processing gas creates a nonburning thermal energy front within the oil shale formation so as to convert kerogen in the oil shale to hydrocarbonaceous products. The products are withdrawn with the processing gas through an effluent gas conduit positioned around the opening of the hole, and are then transferred to a condenser wherein a liquid fraction of the products is formed and separated from a gaseous fraction.

20 Claims, 2 Drawing Sheets

RECOVERY OF PRODUCTS FROM OIL SHALE

FIELD OF THE INVENTION

The present invention relates to the recovery of products from oil shale, and in particular, to a process and system for recovering hydrocarbonaceous products from oil shale.

BACKGROUND OF THE INVENTION

The term "oil shale" refers to a marlstone deposit interspersed with an organic mixture of complex chemical compounds collectively referred to as "kerogen." The inorganic marlstone consists of laminated sedimentary rock containing mainly clay with fine sand, calcite, dolomite, and iron compounds. When the oil shale is heated to about 250–400° F., destructive distillation of the kerogen occurs to produce products in the form of oil, gas, and residual carbon. The hydrocarbonaceous products resulting from the destructive distillation of the kerogen have uses which are similar to petroleum products. Indeed, oil shale is considered to be one of the primary sources for producing liquid fuels and natural gas to supplement and augment those fuels currently produced from petroleum sources.

Processes for recovering hydrocarbonaceous products from oil 'shale may generally be divided into in situ processes and above-ground processes. In situ processes involve treating oil shale which is still in the ground in order to remove the kerogen, while above-ground processes require removing the oil shale from the ground through mining procedures and then subsequently retorting the oil shale in above-ground retort equipment. Clearly, in situ processes are economically desirable since removal of the oil shale from the ground is often expensive. However, in situ processes are generally not as efficient as above-ground processes in terms of total product recovery.

Historically, prior art in situ processes have generally only been concerned with recovering products from oil shale which comes to the surface of the ground; thus, prior art processes have typically not been capable of recovering products from oil shale located at great depths below the ground surface. For example, typical prior art in situ processes generally only treat oil shale which is 100 feet or less below the ground surface. However, many oil shale deposits extend far beyond the 100 foot depth level; in fact, oil shale deposits of 3000 feet or more deep are not uncommon.

Moreover, many, if not most, prior art processes are directed towards recovering products from what is known as the "mahogany" layer of the oil shale. The mahogany layer is the richest zone of the oil shale bed, having a Fischer assay of about twenty-five gallons per ton (25 gal/ton) or greater. Although the mahogany layer is typically only about four feet thick, this layer has often been the only portion of the oil shale bed to which many prior art processes have been applied.

For economic reasons, it has been found generally uneconomical in the prior art to recover products from any other area of the oil shale bed than the mahogany zone.

Thus, there exists a relatively untapped resource of oil shale, especially deep-lying oil shale and oil shale outside of the mahogany zone, which have not been treated by prior art processes mainly due to the absence of an economically viable method for recovering products from such oil shale.

Another important disadvantage of many, if not most prior art in situ oil shale processes is that expensive rubilization procedures are necessary before treating the oil shale. Rubilization of the in situ oil shale formation is typically accomplished by triggering underground explosions so as to break up the oil shale formation. In such prior art process, it has been necessary to rubilize the oil shale formation so as to provide a substantial reduction in the particle size of the oil shale. By reducing the particle size, the surface area of the oil shale treated is increased, in an attempt to recover a more substantial portion of products therefrom. However, rubilization procedures are expensive, time-consuming, and often cause the ground surface to recede so as to significantly destroy the structural integrity of the underground formation and the terrain supported thereby. This destruction of the structural integrity of the ground and surrounding terrain is a source of great environmental concern.

Rubilization of the oil shale in prior art in situ processes has a further disadvantage. Upon destructive distillation of the kerogen in the oil shale to produce various hydrocarbonaceous products, these products seek the path of lease resistance when escaping through the marlstone of the oil shale formation. By rubilizing the oil shale formation, many different paths of escape are created for the products; the result is that it is difficult to predict the path which the products will follow. This, of course, is important in terms of withdrawing the products from the rubilized oil shale formation so as to enable maximum recovery of the products. Since the products have numerous possible escape paths to follow within the rubilized oil shale formation, the task of recovering the products is greatly complicated.

Other significant problems encountered in many prior art in situ processes for recovering products from oil shale stem from problems in controlling the combustion front established within the oil shale bed which pyrolyzes the kerogen. Typically, a hole is formed within the oil shale bed and a burner is inserted into the hole to provide a burning combustion front for pyrolyzing the kerogen.

Disadvantageously, each hole requires its own burner, which significantly increases the costs of the process. Moreover, if the hole is not straight, problems are encountered in inserting the burner down the hole. Further, it is extremely difficult, if not impossible, to use such burners to heat oil shale which is deeper than a few hundred feet below the ground surface.

Perhaps most importantly, the burning combustion fronts established by the burners in these processes are generally difficult to control since the burners are underground, thereby making it difficult to accurately measure the operation conditions and thus to optimize those conditions by controlling the burners. For example, it is difficult to control or measure the amount of oxygen which must be supplied to the underground burners in order to support the burning combustion fronts; the result is poor stoichiometric control.

It is also difficult to control or accurately measure the temperature of the burning combustion front. Since radiation heat from such underground burners typically results in uneven heating of the oil shale formation, hot and cold spots within the oil shale are often experienced.

The result of such underground burner systems is a poorly controlled and economically inefficient system for pyrolyzing the kerogen and recovering a substantial portion of the products from the oil shale.

Thus, from the foregoing, it will be appreciated that it would be a significant advancement in the art to provide a process and system for recovering hydrocarbonaceous products from an in situ oil shale formation at any depth, and in particular, at depths of up to 3000 feet or greater. Additionally, it would be a significant advancement in the art to recover products from regions of in situ oil shale formations which prior art processes have been economically incapable of treating. Moreover, it would be a significant advancement in the art to provide a process and system for recovering hydrocarbonaceous products from an in situ oil shale formation wherein expensive and time-consuming rubilization procedures are eliminated, in order to preserve the structural integrity of the ground and surrounding terrain, and to eliminate the creation of numerous escape paths for the hydrocarbonaceous products, thereby making the flow path of the products more predictable so as to maximize recovery of the hydrocarbonaceous products. Further, the reduction of maintenance costs accrued by placing burner mechanisms above-ground would provide a significant advantage. Finally, it would be a significant advancement in the art to provide a process and system for recovering hydrocarbonaceous products from an in situ oil shale formation wherein the problems of burning combustion fronts within the oil shale formation, produced by underground burners or other means, are eliminated.

SUMMARY OF THE INVENTION

These and other objects are achieved by providing a hot gas process and system for recovering hydrocarbonaceous products from in situ oil shale formations. Unlike many prior art processes, the in situ body of oil shale to be treated is not rubilized.

The process includes first drilling a hole in the body of nonrubilized oil shale, and locating a processing gas inlet conduit within the hole such that the bottom end of the processing inlet gas conduit is near the bottom of the hole. An effluent gas conduit is anchored around the opening of the hole at the ground surface of the body of oil shale.

A processing gas is pressurized in an above-ground compressor and maintained within the system at a pressure of about 5 pounds per square inch ("psi") to about 250 psi, and the pressurized processing gas is introduced into an above-ground combustor. In the combustor, the processing gas, which contains enough oxygen to support combustion, is heated by burning a combustible material introduced into the combustor in the presence of the processing gas.

The resultant heated processing gas is of a temperature sufficient to convert kerogen in the oil shale to hydrocarbonaceous products.

The heated, pressurized processing gas then passes from the combustor through the processing gas inlet conduit and into the hole at a rate in the range of about 200 cubic feet per minute ("cfm") to about 800 cfm. Heat from the heated processing gas, as well as radiant heat from the processing gas inlet conduit, create a nonburning thermal energy front in the oil shale surrounding the hole. The kerogen is thus pyrolyzed and converted into hydrocarbonaceous products. The products produced during pyrolysis of the kerogen are primarily in gaseous form and are withdrawn with the processing gas as an effluent gas through the hole and into the effluent gas conduit.

The effluent gas is transferred through the effluent gas conduit into a condenser where the effluent gas is allowed to expand and cool so as to condense a portion of the hydrocarbonaceous products into a liquid fraction. In the condenser, a remaining gaseous fraction of hydrocarbonaceous products is separated from the liquid fraction of hydrocarbonaceous products. The gaseous fraction is preferably scrubbed so as to separate an upgraded hydrocarbon gas from a waste inorganic gas containing carbon dioxide. A portion of the upgraded hydrocarbon gas may be recycled to the combustor to provide combustible material for fueling combustion within the combustor, while a portion of the waste inorganic gas may be recycled to the compressor for augmenting the supply of carbon dioxide in the processing gas. The carbon dioxide in the processing gas aids migration of the thermal energy front within the body of oil shale.

The present invention provides a process and system for recovering hydrocarbonaceous products from an in situ oil shale formation at potentially any depth to which a hole can be drilled in the oil shale formation. Thus, oil shale as deep as 3000 feet or deeper may be treated using the present invention. Moreover, the present invention provides an economical process and system for recovering hydrocarbonaceous products from all regions of an oil shale formation. Further, by eliminating the need for rubilization, expensive and time-consuming rubilization procedures are avoided, and the structural integrity of the ground and single hole for introducing the processing gas and for removing the hydrocarbonaceous products, and by not rubilizing the oil shale formation, the hole forms a single natural escape path for the hydrocarbonaceous products, thereby maximizing recovery of the products. Additionally, since the thermal energy front used to pyrolyze the kerogen in the present invention is a nonburning thermal energy front created by the introduction of the heated processing gas through the processing gas inlet conduit and into the hole, the problems of the prior art burning combustion fronts (produced, for example, by underground burners) are eliminated. Positioning of the compressor and combustor above the ground, outside the oil shale formation in accordance with the present invention, also allows for 'more careful control of the pressure and temperature of the processing gas and thus of the processing conditions within the oil shale formation.

The present invention provides a process and system for recovering hydrocarbonaceous products from in situ oil shale formations at greater depths than prior art processes and at virtually any depth to which a hole may be drilled in the oil shale.

The features of the invention believed to be patentable are set forth with particularity in the appended claims. The invention itself, however, both as to organization and method of operation, together with further objects and advantages thereof, may best be understood by reference to the following description taken in conjunction with the accompanying drawings.

The present provides an economical process and system for recovering hydrocarbonaceous products from all regions of in situ oil shale formations. Expensive and time-consuming rubilization procedures are eliminated, and the structural integrity of the ground and surrounding terrain are preserved. Further, the recovery path of the hydrocarbonaceous products is predictable and constant, thereby maximizing recovery of the hydrocarbonaceous products.

In an embodiment, the oil shale is treated by a processing gas which is pressurized and heated outside of the oil shale formation so as to avoid the problems of burning combustion fronts and underground burners.

These and other objects and features of the present invention will become more fully apparent from the following description and appended claims, taken in conjunction with the accompanying drawings.

DETAILED DESCRIPTION OF THE INVENTION

Figure 2:
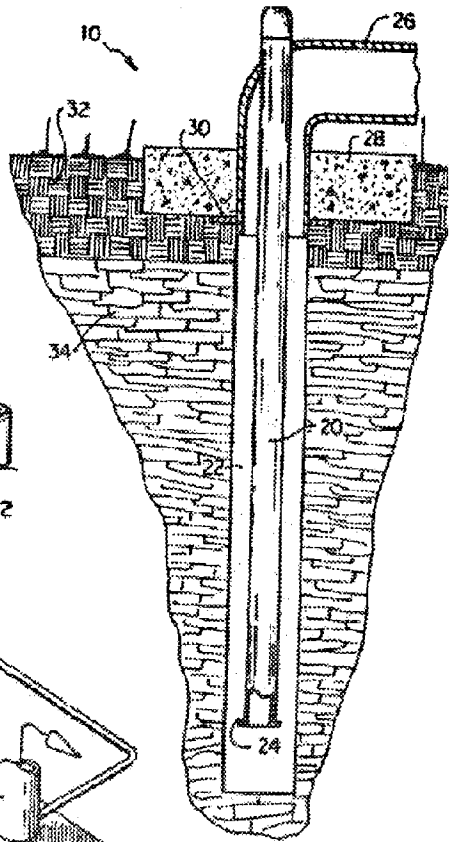
FIG. 2 illustrates a detailed, cutaway cross-sectional view of the FIG. 1 embodiment in which the underground portions of the system are shown in the in situ oil shale formation.

While this invention is susceptible of embodiment in many different forms, there is shown in the drawings, and will herein be described in detail, exemplary embodiments, with the understanding that the present disclosure is to be considered as illustrative of the principles of the invention and not intended to limit the invention to the exemplary embodiments shown and described.

Figure 1:
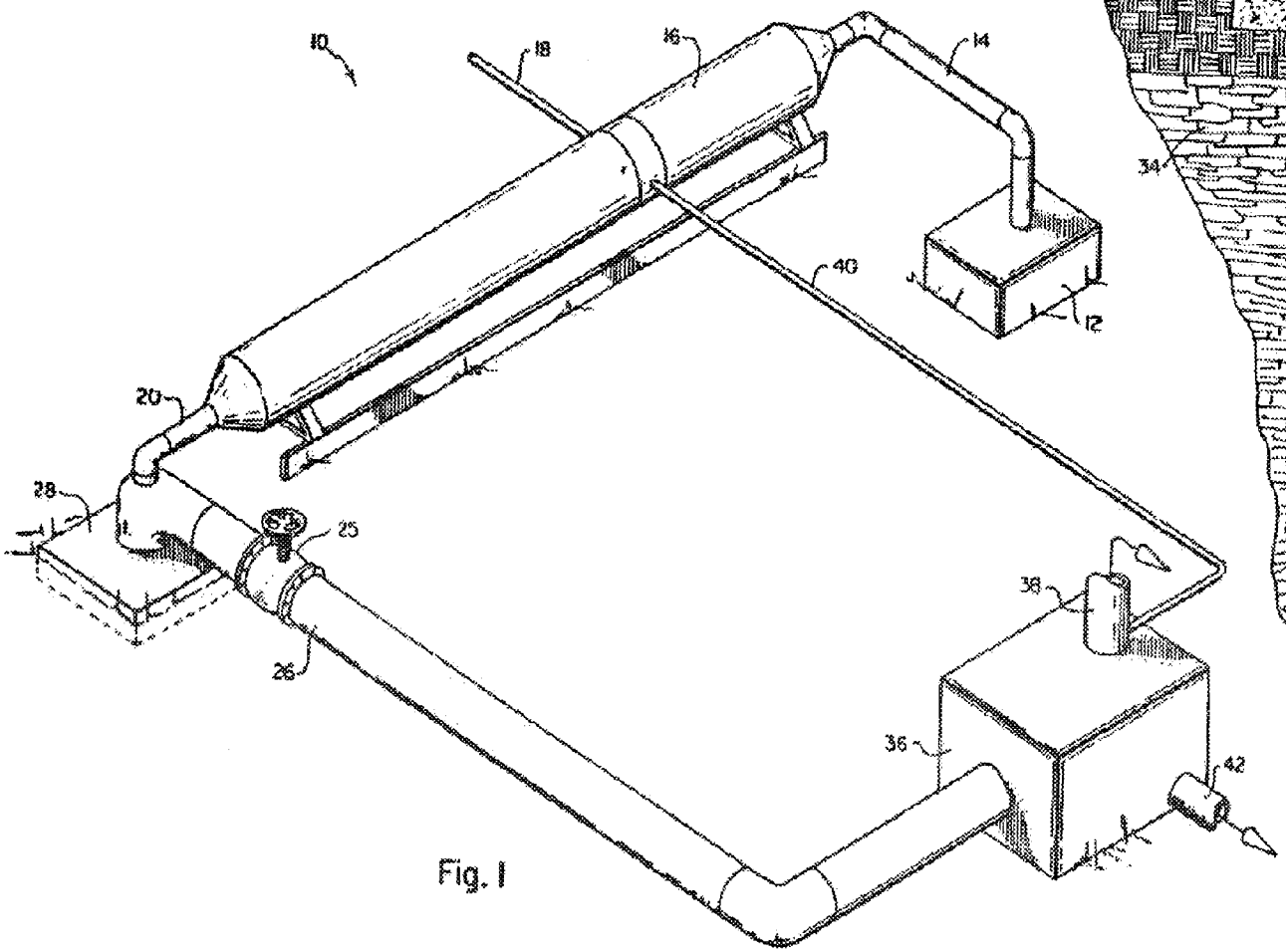
FIG. 1 is a schematic illustration of a process and system of the present invention.

An embodiment of the process and system of the present invention, generally designated 10, is illustrated in FIG. 1. The system 10 includes a compressor 12 located above-ground, outside of the oil shale formation. The compressor 12 serves to pressurize a processing gas such that the processing gas within system 10 is maintained at a pressure in the range of about 5 psi to about 250 psi. It is contemplated that pressurizing the processing gas in a range of about 60 psi to about 110 psi, particularly at around 80 psi to 90 psi, will produce favorable results.

The system 10 further includes an above-ground combustor 16, also located outside the oil shale formation. The combustor 16 heats the pressurized processing gas by burning a combustible material introduced into combustor 16 through a supply conduit 18 in the presence of the processing gas. The combustor 16 thus serves to heat the pressurized processing gas to a temperature sufficient to pyrolyze kerogen in the oil shale formation; hence the kerogen is converted to hydrocarbonaceous products. A gas conduit 14 provides for gaseous communication between the compressor 12 and the combustor 16. A hole 22 is drilled through an overburden 32 and into an oil shale body or formation 34 to be treated.

A processing gas inlet conduit 20 is disposed within hole 22. Preferably, the conduit 20 is constructed of a heat conductive and refractory material (for example, stainless steel) which is capable of withstanding temperatures of up to 2000° F. or more. The conduit 20 is configured with a rolled end 24 to minimize erosion of the conduit end.

In the illustrated embodiment, the processing gas inlet conduit 20 is positioned within hole 22 by a distance of at least about twice the diameter of the conduit 20. The processing gas inlet conduit 20 is in gaseous communication with the combustor 16, and thus provides for the introduction of the heated, pressurized processing gas from the combustor 16 into the hole 22. The processing gas inlet can be provided with a mechanism (not shown) for measuring the temperature and the flow rate of the processing gas within the processing gas inlet conduit 20.

An effluent gas conduit 26 is positioned around the opening of the hole 22 for receiving an effluent gas which includes the processing gas and hydrocarbonaceous products formed from the pyrolysis of the kerogen. The effluent gas conduit 26 can be secured to the ground surface of the overburden 32 by a concrete thrust block 28 which rests against a thrust ring or flange 30 welded to the effluent gas conduit 26. The concrete thrust block 28 can be provided in several pieces to provide for easier installation and removal of the thrust block 28. The thrust block 28 must be of sufficient mass to resist the relatively high pressure thrust created by the effluent gas leaving the hole 22 through the effluent gas conduit 26. While it is contemplated that the thrust block 28 can be made of a readily available and inexpensive material such as concrete, it will be recognized by those of skill in the art that any suitably heavy material may be used.

As shown in FIGS. 1 and 2, a hole is provided in the effluent gas conduit 26 to accommodate processing gas inlet conduit 20 passing therethrough. Additionally, the effluent gas conduit 26 is provided with a valve 25 for regulating the flow of effluent gas through the conduit 26, thus permitting selective control of back pressure within the hole 22, the conduit 20, and the rest of the system 10. In this manner, the valve 25 permits adjustment of the pressure within system 10 to maintain the pressure within desired ranges, such as the ranges described above.

Preferably, effluent gas conduit 26 is also provided with a mechanism (not shown) for measuring the temperature and the flow rate of the effluent gas within the effluent gas conduit 26. By monitoring the temperature and flow rate of the effluent gas, greater control over the recovered product can be realized.

The effluent gas conduit 26 further serves to transfer the effluent gas to an above-ground condenser 36, also located outside the oil shale formation. The condenser 36 is provided as an enlarged-cross-sectional portion of the effluent gas conduit 26. The enlarged cross-section of the condenser 36 reduces the velocity of the effluent gas passing therethrough, causing heavy particles suspended in the gas to drop, and separating the hydrocarbonaceous products within the condenser 36 into a gaseous fractions and a liquid fraction. Depending upon the proportion of fractions desired, additional cooling mechanisms, such as the introduction of outside air, cooling water from cooling tower, or chilled water, could be employed.

The gaseous fractions of hydrocarbonaceous products are removed from the top of the condenser 36 through a conduit 38, where they are recovered. The liquid fractions of the hydrocarbonaceous products are removed from the bottom of the condenser 36 through a conduit 42 for subsequent recovery and storage A recycling conduit 40 between the conduit 38 and the combustor 16 provides for the optional recycling of a portion of the gaseous fraction of hydrocarbonaceous products to the combustor 16. If desired, a mechanism for scrubbing the gaseous fraction can be provided for separating waste inorganic gas from the hydrocarbon gas in the gaseous fraction such that the upgraded hydrocarbon gas will burn more readily in the combustor 16. Moreover, a mechanism can be provided for recycling a portion of the waste inorganic gas (which contains carbon dioxide) to the compressor 12 so as to augment the concentration of carbon dioxide in the processing gas.

Operation of system 10 will be understood from the following discussion. A processing gas (e.g., air) is first pressurized within the compressor 12 so as to maintain the processing gas within the system 10 within a desired pressure range. The processing gas should contain enough oxygen, typically at least 16% under most conditions, to enable the processing gas to support combustion of the combustible material within the combustor 16. Optionally, for reasons which will be explained in more detail hereinafter, the processing gas may also contain from about 5% to about 20% water vapor by weight.

Once pressurized, the processing gas is transferred from the compressor 12 to the combustor 16 through the gas conduit 14. The pressurized processing gas within the combustor 16 is mixed with a combustible material introduced into the combustor 16 through the supply conduit 18 and/or a recycling conduit 40. The combustible material/processing gas mixture is then combusted within the combustor 16 so as to heat the processing gas to a temperature sufficient to pyrolyze the kerogen in the oil shale formation 34. As will be explained hereinafter, the temperature of the heated processing gas within the combustor 16 is such that when the temperature of the processing gas is measured in effluent gas conduit 26, the temperature of the processing gas is in the range of about 200° F. to about 2000° F.

The heated, pressurized processing gas exits the combustor 16 and enters the processing gas inlet conduit 20 at a rate of about 200 cfm to about 800 cfm. It is contemplated that a rate of about 300 cfm to about 600 cfm, and particularly a rate of about 450 cfm to about 500 cfm, will produce favorable results. The temperature and flow rate of the processing gas within the processing gas inlet conduit 20 are measured as desired.

After entering the processing gas conduit 20, the processing gas flows downwardly through the conduit 20 and out of the conduit end 24 into the hole 22. The pressurized processing gas serves to pressurize the oil shale formation 34, and the processing gas ultimately escapes upwardly through the hole 22 and into the effluent gas conduit 26. The heated processing gas injected into the hole 22 through the processing gas inlet conduit 20 serves to heat the oil shale formation 34 surrounding the hole 22, thus creating a nonburning thermal energy front within oil shale formation 34. The intense heating of the hole 22 by the pressurized, heated processing gas, as well as the actual penetration of the heated processing gas into oil shale formation 34, causes the thermal energy front to migrate in a radial direction away from the hole 22. Formation and migration of the nonburning thermal energy front is encouraged primarily by the direct action of the heated processing gas, but it is also encouraged by radiation heat from the conduit 20 which is preferably constructed of a heat conductive material. The rate of migration of the nonburning thermal energy front may, therefore, be controlled by adjusting the temperature and pressure of the processing gas.

Thermal migration of the thermal energy front may be further encouraged by the addition of carbon dioxide gas to the processing gas. Carbon dioxide acts to penetrate the kerogen in the oil shale formation. This reduces the viscosity of the kerogen and enables the thermal energy front to travel more rapidly and convert the kerogen into hydrocarbonaceous products at a faster rate. Augmentation of the carbon dioxide concentration in the processing gas may be accomplished by various means. In one embodiment, carbon dioxide is supplied to the processing gas by recycling a portion of the waste inorganic gas separated from the gaseous fraction of hydrocarbonaceous products to the combustor 16.

Additionally, water vapor from about 5% to about 20% by weight may optionally be added to the processing gas in order to increase the enthalpy within the system. Since water vapor has a higher heat capacity than many other gases naturally found in the air, the water vapor will be capable of carrying more heat energy to the oil shale formation. This added heat will, of course, further aid the migration of the thermal energy front through the oil shale formation 34.

As oil shale formation 34 is heated by the thermal energy front, the kerogen is pyrolyzed into hydrocarbonaceous products. The temperature within the oil shale formation is such that these products remain primarily in the gaseous state while within the oil shale formation. Typically, such hydrocarbonaceous products would include about 45% gasoline, about 26% kerosene, and about 24% heavy hydrocarbons. It will be appreciated, however, that the exact composition and quantities of the hydrocarbonaceous products formed will depend upon the nature and composition of the oil shale treated.

These gaseous hydrocarbonaceous products exit the oil shale formation 34 through the path of least resistance, namely, the hole 22, where they are swept by the processing gas into the effluent gas conduit 26. Thus, the processing gas and hydrocarbonaceous products form an effluent gas.

The flow of the effluent gas through conduit 26 is controlled by adjusting the valve 25. By controlling the flow of the effluent gas through the conduit 26, the back pressure experienced by the processing gas in the hole 22, the conduit 20, and the rest of system 10, is also controlled. Moreover, the temperature and flow rate of the effluent gas within the effluent gas conduit 26 can be measured and monitored as frequently as is necessary.

The effluent gas passes through the effluent gas conduit 26 and enters the condenser 36 where the effluent gas is allowed to expand and cool. As the effluent gas cools, a portion of the gas condenses into a liquid fraction, with a gaseous fraction remaining. The gaseous fraction is withdrawn from the top of the condenser 36 through the conduit 38, while the liquid fraction is withdrawn from the bottom of the condenser 36 through the conduit 42 for subsequent storage and use.

Typically, the gaseous fraction has a potential heat content of about 350–550 btu per cubic foot (btu/ft$^3$). Thus, in order to upgrade the gaseous fraction for use as fuel, it is generally desirable to scrub the gas by conventional techniques so as to raise the potential heat content of the gaseous fraction to about 1000 btu/ft$^3$. Such scrubbing of the gaseous fraction would occur before the gaseous fraction is recycled through conduit 40 to the combustor 16.

As mentioned previously, scrubbing the gaseous fraction yields an upgraded hydrocarbon gas and a waste inorganic gas containing carbon dioxide. If desired, a portion of the upgraded hydrocarbon gas may be optionally recycled from the conduit 38 into the combustor 16 by means of recycling conduit 40. Such recycling of the gaseous fraction provides gaseous combustible material to support combustion within the combustor 16.

If desired, a portion of the waste inorganic gas may be recycled to the compressor 12 so as to augment the concentration of carbon dioxide in the processing gas. It will be appreciated that a portion of the liquid fraction of hydrocarbonaceous products may also be recycled to the combustor 16, either in lieu of or in combination with the recycled gaseous fraction.

It is contemplated that the heat of the effluent gas can be used for various purposes. For example, by bringing effluent gas from the effluent gas conduit 26 into heat exchange relationship with the processing gas flowing through the conduit 14, the processing gas pressurized in the compressor 12 may be preheated on its way to the combustor 16. An additional option is to use the heat from the effluent gas to help drive the compressor 12. This may be done, for example, by bringing effluent gas from the effluent gas conduit 26 into heat exchange relationship with water, such that the water turns into steam upon receiving heat from the effluent gas, and the steam is used to drive an electric generator which in turn produces electrical power for driving the compressor 12.

Further flexibility of the process and system of the present invention relates to preheating the oil shale formation before pyrolyzing the kerogen within the oil shale formation. Such preheating can be accomplished by first heating the processing gas such that the temperature of the effluent gas measured within the effluent gas conduit 26 is in the range of about 500° F. to about 700° F. Subsequently, the processing gas is heated to the higher temperatures disclosed herein for pyrolyzing the kerogen. By first preheating the oil shale formation before pyrolyzing the kerogen to produce the hydrocarbonaceous products, thermal shock to the oil shale formation can be significantly reduced. This reduces thermal damage done to the oil shale formation, such as the effects to the structural integrity of the oil shale formation.

Figure 3:
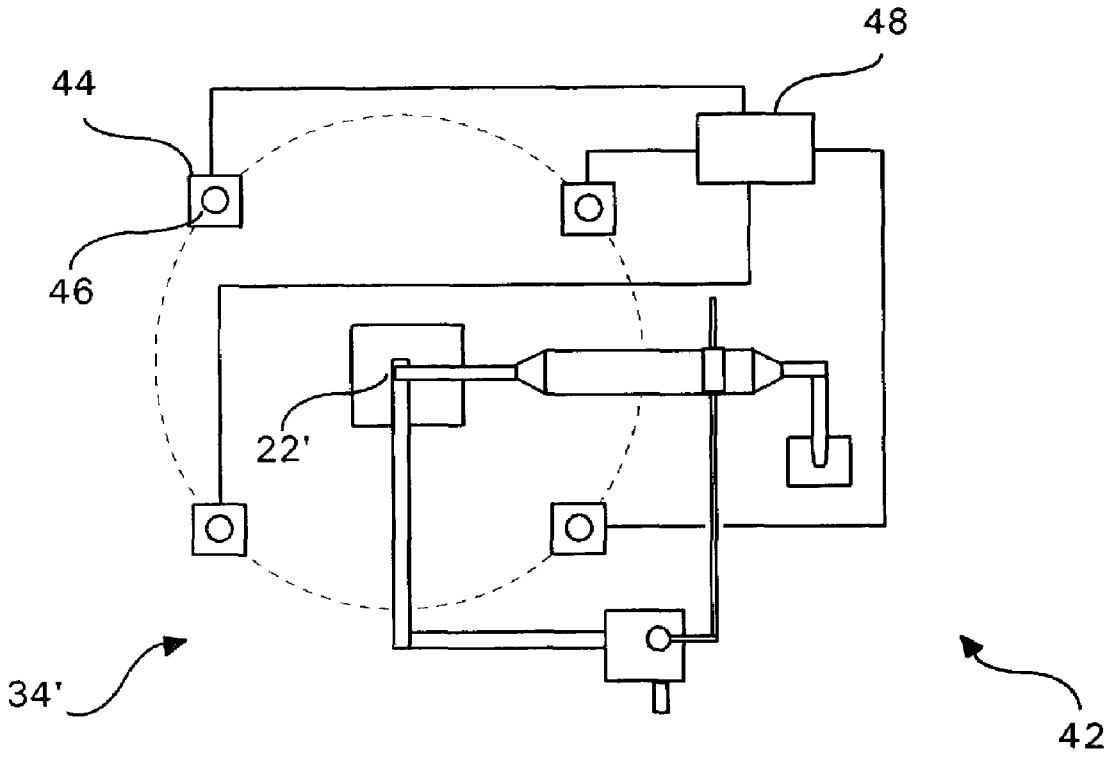
FIG. 3 illustrates a detailed view of an embodiment of the present invention incorporating a vibration-inducing mechanism for enhancing extraction efficacy of product.

An alternative embodiment of a system 42 in accordance with the principles of the present invention is shown in FIG. 3. The system 42 is identical to that shown in FIGS. 1 and 2, with the addition of one or more resonant tubes 44. The resonant tubes 44 are installed in cored holes 46 placed on a diameter of between 5 ft. and 50 ft. Around the production hole 22'. The resonant tubes 44 are excited by a signal generator 48 installed at grade. The signal generator 48 can be provided as a variable frequency signal generator capable of generating a wide range of frequencies, both within and outside of the audible range.

In operation, the resonant tubes 44 are excited by the generator 48 to produce a vibration within the oil shale formation 34'. The vibration will primarily affect the carbonaceous product when it has become liquid, enhancing movement of the carbonaceous product through the formation to the production hole 22'. It presently contemplated that the vibration will have little effect on formation-contained product which is not yet heated, or on the migration of vaporized product to the production hole 22'.

It is also contemplated that the vibration produced by the resonant tubes 44 will serve to reduce the surface tension of the liquid carbonaceous product, and to reduce the effective friction between the moving liquid and the stationary formation. This will improve the efficiency of product movement through the formation and toward the heat source. It is presently thought that favorable results will be obtained by vertically positioning the resonant tubes at 25% to 50% of the height of the formation being processed, and that a relatively small amount of power, in a range of around 1 to 6 kilowatts, will be required to operate the system.

It is also contemplated that the downhole temperature may be chosen in a range of 200° F. to 2100° F., depending upon the nature of the formation and by the desired composition of product to be extracted. For example, different effluent characteristics may be deemed to be commercially viable during a predetermined process cycle, e.g., water, carbonaceous liquid, or gaseous product.

Because the present invention does not involve the use of a burning combustion front or underground burners, but instead requires only the drilling of a hole within the oil shale formation, oil shale at virtually any depth may be treated. The only limitation to the depth at which effective treatment of the oil shale may be performed is the depth to which a hole may be drilled into the oil shale. Moreover, by avoiding the expense of underground burners in every hole, the present invention provides a system which is economical for treating oil shale at virtually any region of the oil shale formation.

Additionally, because the present invention does not require the insertion of a burner into the hole formed in the oil shale formation, the hole drilled into the oil shale formation need not be straight. Thus, the processing gas inlet conduit 20 may be formed of flexible material in the event that the conduit is to be inserted into a hole which is not vertically straight.

Further advantageous effect of the present invention is achieved by avoiding expensive and time-consuming rubilization procedures. Moreover, treating the oil shale formation in a nonrubilized state also preserves the structural integrity of the ground and surrounding terrain, thereby greatly alleviating environmental concerns. The only disturbance of the environment needed to carry out the present invention is the drilling of a hole in the oil shale, which hole may be subsequently filled with dirt or other material. Indeed, after treatment of the oil shale in accordance with the present invention, the resulting compressive strength of the ground is about ninety-two percent (92%) of the original compressive strength before treatment, and the temperature of the ground surface is typically raised by only about 1° F.

Moreover, by maintaining the oil shale formation in a nonrubilized state and by drilling a single hole to introduce the processing gas and withdraw hydrocarbonaceous products, the escape path of the hydrocarbonaceous products formed within the oil shale formation is extremely predictable, i.e., the escape path will be the hole itself. This greatly facilitates recovery of the hydrocarbonaceous products formed and maximizes the total amount of products recovered.

Since the present invention does not employ a burning combustion front or underground burners, the problems of controlling and optimizing processing conditions are avoided. Thus, hot and cold spots within the oil shale formation are also avoided.

Importantly, the present invention provides a process and system for carefully controlling process conditions and for providing an even distribution of heat throughout the oil shale formation during pyrolysis. Since the compressor and combustor are located above the ground and outside the oil shale formation, regulation of the pressure and temperature of the processing gas, as well as the composition of the processing gas itself, is more easily achieved. Moreover, the present invention provides a simple, yet accurate method for measuring the temperature and flow rate of both the processing gas and the effluent gas by measuring the temperature and flow rate of these gases in the processing gas inlet conduit 20 and effluent gas conduit 26, respectively.

By keeping the processing gas at a temperature such that the measured temperature of the effluent gas within the effluent gas conduit 26 is within the range of about 200° F. to about 2000° F., the processing gas is maintained at a temperature sufficient to pyrolyze the kerogen in the oil shale such that the hydrocarbonaceous products formed are primarily in the gaseous state. It will be recognized that, although temperatures higher than this are possible in the present invention, it may be economically desirable to remove the products in a gaseous form using the least amount of heat energy necessary. Thus, the temperature of the processing gas should be maintained high enough to pyrolyze the kerogen in such a manner that the products formed are primarily gaseous, while minimizing the amount of heat supplied to the processing gas for purposes of economic efficiency. Thus, the temperatures disclosed herein may vary somewhat from one oil shale formation to another, depending on the temperature needed to obtain the desired proportion of phases of product.

Introduction of the already heated and pressurized processing gas into the hole creates a uniform thermal energy front, with the rapidly moving processing gas providing the necessary heat energy for pyrolysis. Also, the present invention provides for rapid recovery of the hydrocarbonaceous products through the rapid circulation of the processing gas through the system.

The present invention provides further advantages not experienced in the prior art. For example, using the above-ground compressor and combustor system of the present invention, a single compressor and combustor may be used to supply heated, pressurized processing gas to several different holes formed throughout a particular oil shale formation. To accomplish this, a manifold (not shown) would be included between the combustor 16 and each of the processing gas inlet conduits 20 leading to each hole 22.

It should be noted that in such a multiple hole operation, the holes should be spaced far enough apart (e.g., about 50–100 feet) so that the effluent gas (which includes the processing gas and the hydrocarbonaceous products) exits the same hole through which the processing gas is introduced. This preserves the advantages of predicting the escape path of the hydrocarbonaceous products achieved by the present invention. Additionally, the effluent gas in each effluent gas conduit 26 of such a multi-hole system could be sent to a common condenser 36 for condensation and separation of the products.

From the foregoing, it will be appreciated that the present invention provides an economical process and system for recovering hydrocarbonaceous products from all regions of in situ oil shale formations and at greater depths than known processes. Further, the present invention provides a hot gas process and system which eliminates the problems related to rubilization of the oil shale formation and burning combustion fronts.

Although the present invention has been described with reference to specific embodiments, those of skill in the art will recognize that changes may be made thereto without departing from the scope and spirit of the invention as defined by the appended claims.

What is claimed is:

1. A process for recovering hydrocarbonaceous products from nonrubilized oil shale, the process comprising the following steps:

forming a hole in a body of nonrubilized oil shale;

positioning a gas inlet conduit into the hole;

pressurizing a processing gas;

heating the processing gas to a temperature sufficient to convert kerogen in the oil shale to hydrocarbonaceous products;

introducing the heated processing gas through the gas inlet conduit and into the hole, thereby creating a nonburning thermal energy front within the oil shale so as to convert kerogen in the oil shale to hydrocarbonaceous products; and removing the hydrocarbonaceous products from the oil shale by withdrawing the processing gas and hydrocarbonaceous products as effluent gas through the hole.

2. A process in accordance with claim 1 wherein the body of nonrubilized oil shale is in situ.

3. A process in accordance with claim 1, wherein the step of forming a hole comprises forming a hole having a depth of about 3000 feet below the ground surface.

4. A process in accordance with claim 1, wherein the step of positioning a gas inlet conduit into the hole comprises positioning a gas inlet conduit is made of heat conductive material into the hole.

5. A process in accordance with claim 1, wherein the step of pressurizing a processing gas comprises pressurizing a processing gas containing at least about 16% oxygen by weight, and the step of heating the processing gas comprises heated the processing gas by burning combustible material in the presence of the processing gas.

6. A process in accordance with claim 5, further comprising the step of augmenting a concentration of carbon dioxide in the processing gas by separating an inorganic gas containing carbon dioxide from the effluent gas and recycling at least a portion of the inorganic gas to the processing gas, the carbon dioxide serving to enhance migration of the thermal energy front through the oil shale.

7. A process in accordance with claim 1 wherein the processing gas comprises between about 5% and 20% water vapor by weight.

8. A process as defined in claim 1 wherein the processing gas is pressurized to a pressure of about 5 psi to about 250 psi and introduced into the gas inlet conduit at a rate of about 200 cfm to about 800 cfm.

9. A process in accordance with claim 1 wherein the processing gas is heated such that the temperature of the effluent gas removed from the hole is from about 900° F. to about 1500° F.

10. A process in accordance with claim 1, wherein the step of heating processing gas comprises the following:

initially preheating the processing gas such that the temperature of the effluent gas removed from the hole is from about 500° F. to about 700° F. to preheat the body of nonrubilized oil shale to reduce thermal shock to the oil shale when the oil shale is subsequently heated to convert the kerogen to hydrocarbonaceous products; and subsequently heating the processing gas such that the temperature of the effluent gas removed from the hole is from about 900° F. to about 1500° F., thereby heating the oil shale sufficiently to convert kerogen within the oil shale to hydrocarbonaceous products.

11. A process for recovering hydrocarbonaceous products from nonrubilized oil shale, the process comprising the following steps:

forming a production hole in a body of nonrubilized oil shale;

positioning a gas inlet conduit into the hole;

pressurizing a processing gas;

heating the processing gas to a temperature sufficient to convert kerogen in the oil shale to hydrocarbonaceous products;

installing at least one resonant tube in a corresponding number of cored holes placed around the production hole;

connecting the at least one resonant tube to a signal generator placed above the surface of the ground;

actuating the signal generator to excite the at least one resonant tube;

introducing the heated processing gas through the gas inlet conduit and into the hole, thereby creating a nonburning thermal energy front within the oil shale so as to convert kerogen in the oil shale to hydrocarbonaceous products; and removing the hydrocarbonaceous products from the oil shale by withdrawing the processing gas and hydrocarbonaceous products as effluent gas through the hole.

12. A process in accordance with claim 11, wherein the step of installing at least one resonant tube comprises installing a plurality of resonant tubes in cored holes placed on a diameter of between 5 ft. and 50 ft. around the production hole.

13. A process in accordance with claim 12, wherein the step of connecting the at least one resonant tube to a signal generator comprises the step of connecting the at least one resonant tube to a signal generator to a variable frequency signal generator capable of generating a wide range of frequencies, both within and outside of the audible range.

14. A process in accordance with claim 11 wherein the processing gas is pressurized and heated, and the resonant tubes are excited, above ground.

15. A process in accordance with claim 13, wherein the step of removing the hydrocarbonaceous products further comprises the step of regulating the flow of the effluent gas through the an effluent gas conduit so as to control back pressure within the process.

16. A process in accordance with claim 11, further comprising the following steps:

condensing a portion of the hydrocarbonaceous products, thereby yielding a gaseous fraction and a liquid fraction; and separating the gaseous fraction from the liquid fraction.

17. A process in accordance with claim 16, further comprising the step of scrubbing the gaseous fraction so as to remove impurities therefrom, thereby improving the combustible properties of the gaseous fraction.

18. A process in accordance with claim 11, further comprising the step of combusting a portion of the hydrocarbonaceous products to provide heat for heating the processing gas.

19. A process in accordance with claim 11, wherein heat from the effluent gas supplies a portion of the heat used to heat the processing gas.

20. A process in accordance with claim 11, wherein the processing gas is pressurized by a compressor and wherein heat from the effluent gas is used to produce steam to drive an electric generator, the electric generator in turn producing electrical power for driving the compressor.

* * * * *